US006557454B2

(12) United States Patent
Miyazawa

(10) Patent No.: US 6,557,454 B2
(45) Date of Patent: May 6, 2003

(54) COMPRESSOR PISTONS

(75) Inventor: Kiyoshi Miyazawa, Isesaki (JP)

(73) Assignee: Sanden Corporation, Gumna (JP)

( * ) Notice: Subject to any disclaimer, the term of this patent is extended or adjusted under 35 U.S.C. 154(b) by 0 days.

(21) Appl. No.: 09/877,003

(22) Filed: Jun. 11, 2001

(65) Prior Publication Data

US 2002/0005115 A1 Jan. 17, 2002

(30) Foreign Application Priority Data

Jul. 12, 2000 (JP) ..... 2000-210719

(51) Int. Cl.[7] ..... F01B 3/00
(52) U.S. Cl. ..... 92/71
(58) Field of Search ..... 92/71, 172; 91/499

(56) References Cited

U.S. PATENT DOCUMENTS

| | | | |
|---|---|---|---|
| 1,714,145 | A | 5/1929 | Sperry |
| 3,369,458 | A | 2/1968 | Slimm |
| 3,800,675 | A | 4/1974 | Jacobs |
| 3,885,460 | A | 5/1975 | Park |
| 3,982,471 | A | 9/1976 | Finger |
| 4,065,229 | A | 12/1977 | Black |
| 4,073,603 | A | 2/1978 | Abendschein et al. |
| 4,145,163 | A | 3/1979 | Fogelberg et al. |
| 4,174,191 | A | 11/1979 | Roberts |
| 4,351,227 | A | 9/1982 | Copp, Jr. et al. |
| 4,379,425 | A | 4/1983 | Ishizuka |
| 4,416,589 | A | 11/1983 | Perry |
| 4,425,837 | A | 1/1984 | Livesay |
| 4,480,964 | A | 11/1984 | Skinner |
| 4,526,516 | A | 7/1985 | Swain et al. |
| 4,594,055 | A | 6/1986 | Hatakeyama et al. |
| 4,664,604 | A | 5/1987 | Terauchi |
| 5,174,728 | A | 12/1992 | Kimura et al. |
| 5,380,166 | A | 1/1995 | Terauchi |
| 5,380,167 | A | 1/1995 | Burkett et al. |
| 5,382,139 | A | 1/1995 | Kawaguchi et al. |
| 5,630,353 | A | 5/1997 | Mittlefehldt et al. |
| 5,765,464 | A | 6/1998 | Morita |
| 5,868,556 | A | 2/1999 | Umemura |
| 5,899,135 | A | 5/1999 | Kanou et al. |
| 6,024,009 | A | 2/2000 | Morita |

FOREIGN PATENT DOCUMENTS

| | | |
|---|---|---|
| EP | 1098090 | 5/2001 |
| GB | 895667 | 2/1961 |
| JP | 07189898 | 7/1995 |
| JP | 07189900 | 7/1996 |
| JP | 11303747 | 11/1999 |
| JP | 2000154776 | 6/2000 |

*Primary Examiner*—Edward K. Look
*Assistant Examiner*—Michael Leslie
(74) *Attorney, Agent, or Firm*—Baker Botts L.L.P.

(57) ABSTRACT

A piston for use in a fluid displacement apparatus includes a head portion and a connecting portion. The head portion has a cylindrical shape and a hollow structure. The head portion comprises an end portion and a cylindrical portion. The end portion fixedly connected to the cylindrical portion. The connecting portion extends from an end surface of the cylindrical portion and couples the piston with a moving source. A pair of apertures are formed through the end surface of the cylindrical portion adjacent to connecting portion. A rib is formed between the pair of apertures. The strength of a circumference portion of the apertures may be increased by the rib. As a result, when the fluid displacement apparatus is operated under a high load, the occurrence of cracks at the circumference portion(s) of the aperture(s) may be reduced or eliminated.

8 Claims, 4 Drawing Sheets

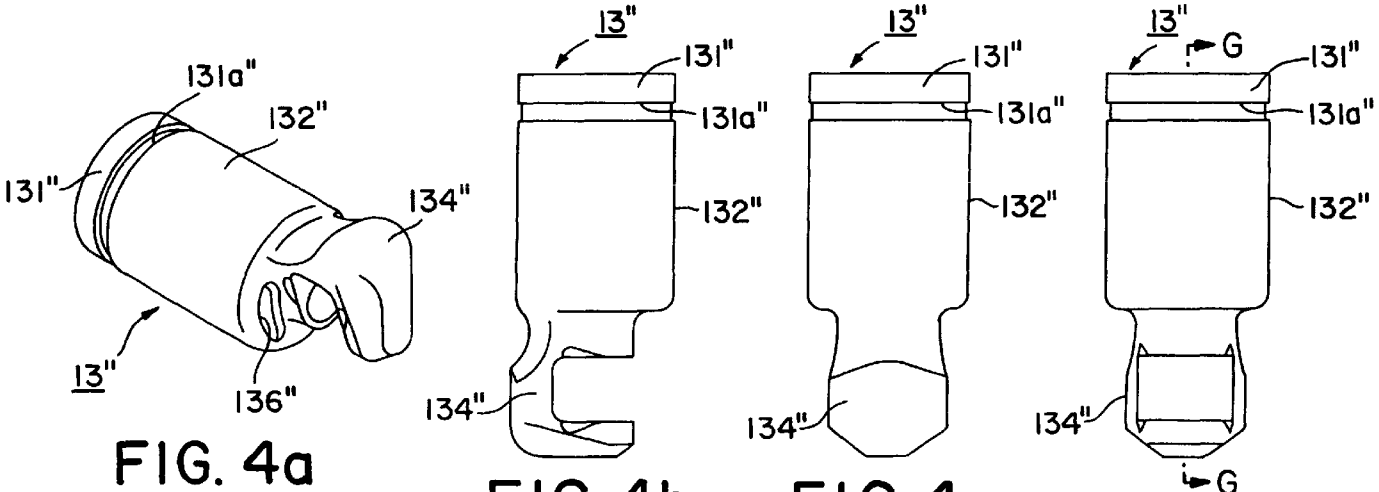
FIG. 4a (PRIOR ART)
FIG. 4b (PRIOR ART)
FIG. 4c (PRIOR ART)
FIG. 4d (PRIOR ART)
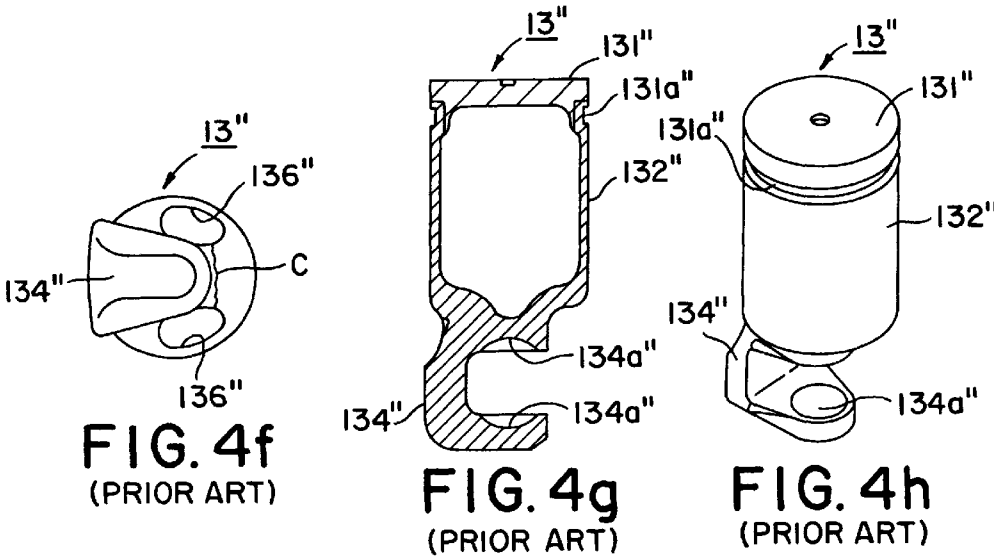
FIG. 4e (PRIOR ART)
FIG. 4f (PRIOR ART)
FIG. 4g (PRIOR ART)
FIG. 4h (PRIOR ART)

COMPRESSOR PISTONS

BACKGROUND OF THE INVENTION

1. Field of the Invention

The present invention relates to compressor pistons for use in compressors or pumps, and more particularly, to pistons for use in fluid displacement apparatus, such as swash plate-type compressors.

2. Description of Related Art

Pistons having hollow structures at their head portions, which slide in cylinder bores of a compressor and maintain airtightness or watertightness between an exterior surface of the head portion and an interior wall of the cylinder bore, are known in the art. For example, Japanese Patent Unexamined Publication No. 11-303747 describes a piston having a hollow structure at its head portion, which is shown in FIGS. 4*a*–4*h*.

Referring to FIGS. 4*a*–4*h*, a piston 13" has a hollow head portion, which comprises an end portion 131" and a cylindrical portion 132". Therefore, piston 13" has an advantage that it is lightweight. Moreover, to realize a further reduction in piston weight, a pair of penetrating apertures 136" are pierced through cylindrical portion 132" at its end on the side of connecting portion 134". However, piston 13" has a disadvantage that the strength of a circumference portion(s) of penetrated aperture(s) 136" may decrease. As a result, when the compressor is operated under high load, a crack C, e.g., as shown in FIG. 4*f*, may originate from the circumference portion(s) of penetrated aperture(s) 136".

SUMMARY OF THE INVENTION

A need has arisen to reduce or eliminate the above-mentioned problems, which may be encountered in known compressor pistons with hollow head portions having penetrating apertures that realize piston weight reductions.

In an embodiment of this invention, a piston for use in a fluid displacement apparatus, such as a swash plate-type compressor, comprises a head portion and a connecting portion. The head portion has a cylindrical shape and a hollow structure. The connecting portion extends from an end surface of the head portion and couples the piston with a moving source. An aperture is formed through the end surface of the head portion adjacent to the connecting portion. A rib is formed adjacent to the aperture.

In another embodiment of this invention, a piston for use in a fluid displacement apparatus, such as a swash plate-type compressor, comprises a head portion and a connecting portion. The head portion has a cylindrical shape and a hollow structure. The head portion comprises an end portion and a cylindrical portion. The end portion is fixedly connected to the cylindrical portion. The connecting portion extends from an end surface of the cylindrical portion and couples the piston with a moving source. A pair of apertures are formed through the end surface of the cylindrical portion adjacent to the connecting portion. A rib is formed between the pair of apertures.

Objects, features, and advantages of embodiments of this invention will be apparent to persons of ordinary skill in the art from the following detailed description of the invention and the accompanying drawings.

BRIEF DESCRIPTION OF THE DRAWINGS

The present invention may be more readily understood with reference to the following drawings.

FIG. 4*a* is a perspective view of a known piston seen from a bottom part of the known piston.

FIG. 4*b* is a front view of the known piston depicted in FIG. 4*a*.

FIG. 4*c* is a left side view of the known piston depicted in FIG. 4*a*.

FIG. 4*d* is a right side view of the known piston depicted in FIG. 4*a*.

FIG. 4*e* is a top plan view of the known piston depicted in FIG. 4*a*.

FIG. 4*f* is a bottom plan view of the known piston depicted in FIG. 4*a*.

FIG. 4*g* is a cross-sectional view taken along the line G—G of FIG. 4*d*.

FIG. 4*h* is another perspective view of the piston seen from an end portion of the known piston depicted in FIG. 4*a*.

DETAILED DESCRIPTION OF PREFERRED EMBODIMENTS

Figure 1D:
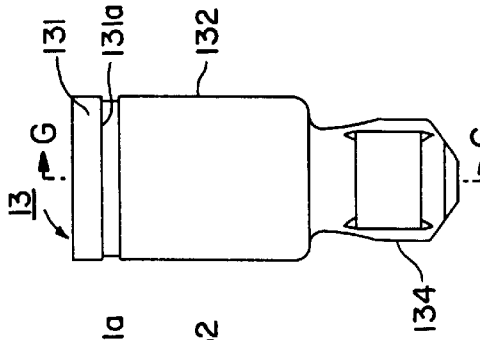
FIG. 1*d* is a right side view of the piston, according to the first embodiment of the present invention.
Figure 1C:
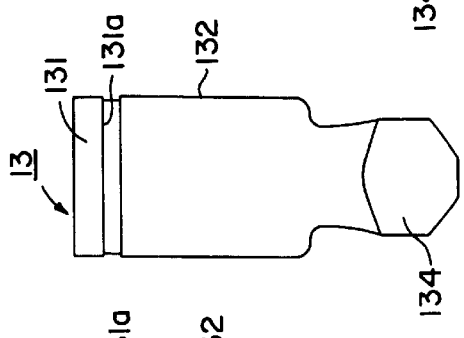
FIG. 1*c* is a left side view of the piston, according to the first embodiment of the present invention.
Figure 1B:
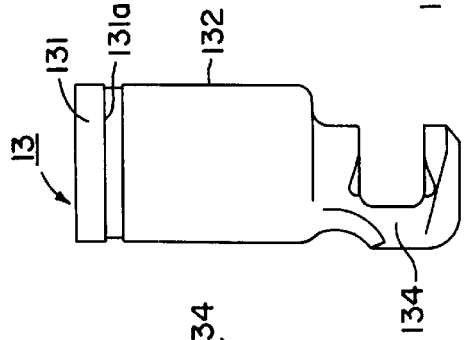
FIG. 1*b* is a front view of the piston, according to the first embodiment of the present invention.
Figure 1A:
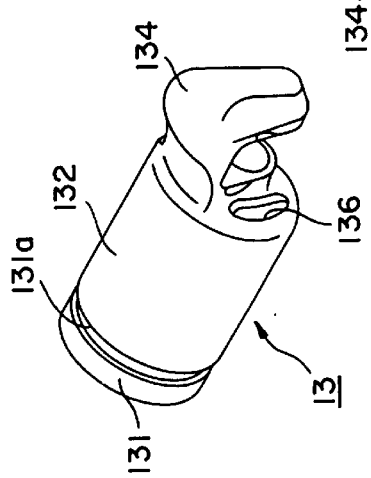
FIG. 1*a* is a perspective view of a piston seen from a connecting portion of the piston, according to a first embodiment of the present invention.
Figure 1H:
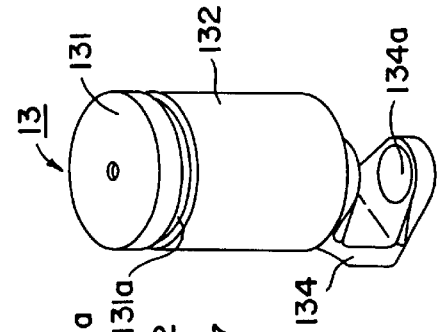
FIG. 1*h* is another perspective view of the piston seen from an end portion of the piston, according to the first embodiment of the present invention.
Figure 1G:
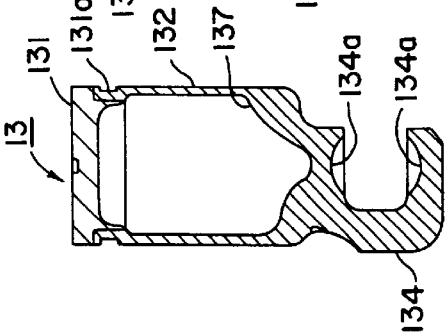
FIG. 1*g* is a cross-sectional view taken along the line G—G of FIG. 1*d*.
Figure 1F:
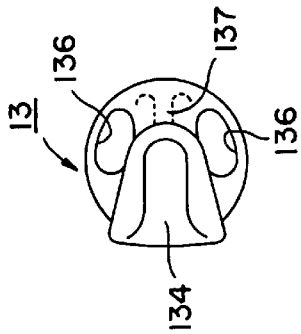
FIG. 1*f* is a bottom plan view of the piston, according to the first embodiment of the present invention.
Figure 1E:
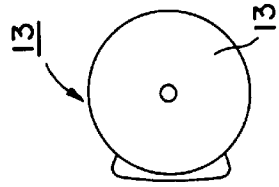
FIG. 1*e* is a top plan view of the piston, according to the first embodiment of the present invention.
Figure 2:
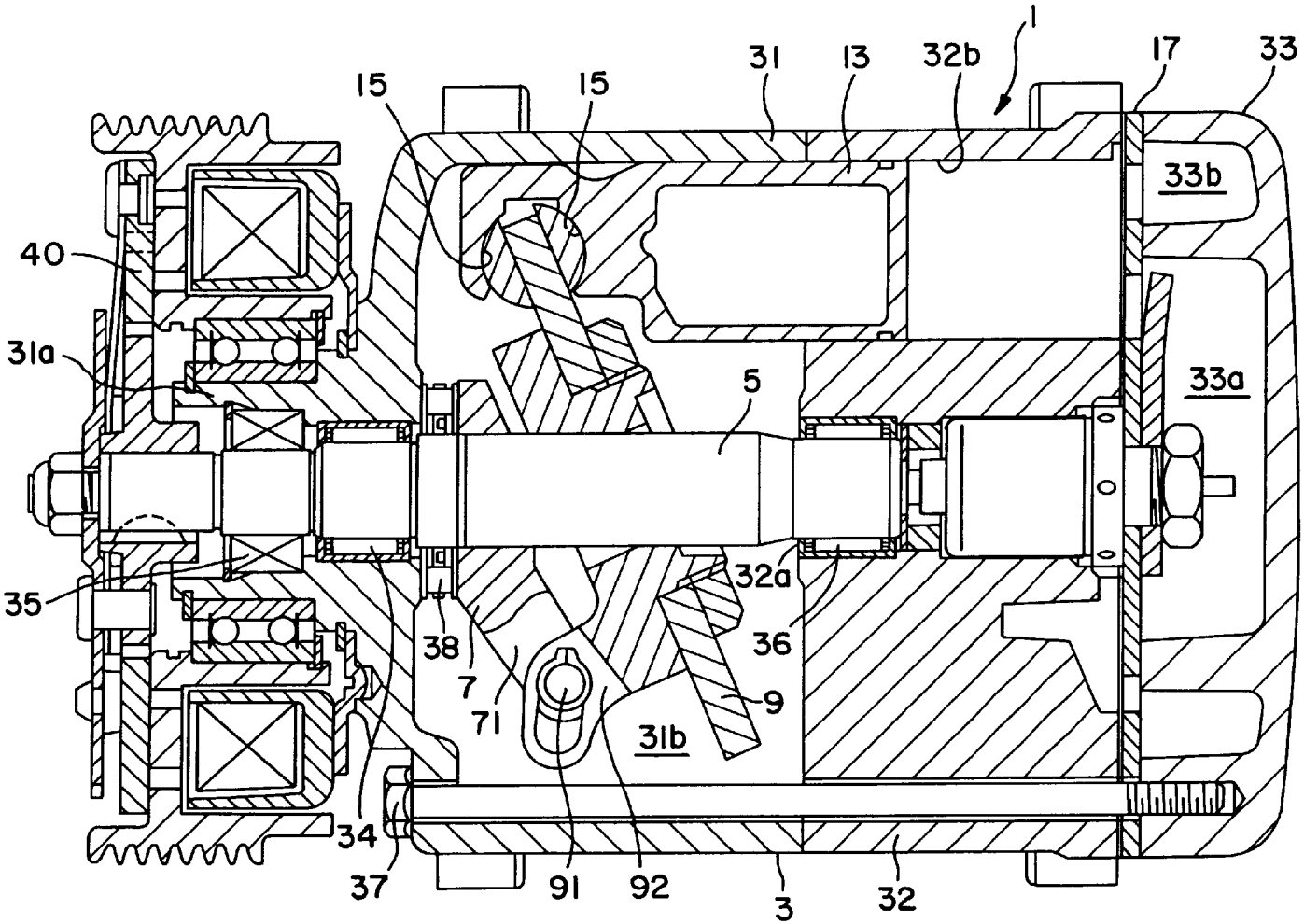
FIG. 2 is a longitudinal, cross-sectional view of a swash plate-type compressor for use in an automotive air-conditioning system which includes the piston depicted in FIGS. 1*a*–1*h*.

FIGS. 1*a*–1*h* show the structure of a piston according to a first embodiment of the present invention and FIG. 2 shows a longitudinal, cross-sectional view of a slant-type compressor for use in an automotive air-conditioning system which includes the piston of FIGS. 1*a*–1*h*.

Referring to FIGS. 1*a*–1*h* and FIG. 2, swash plate-type compressor 1 comprises a housing 3, a drive shaft 5, a swash plate 9, and a plurality of pistons 13. Housing 3 comprises a front housing 31, a cylinder block 32, and cylinder head 33. Front housing 31 has a substantially funnel-shape and has a cylindrical portion 31*a* at its front end and a crank chamber 31*b* at the inside of its back end. A drive bearing 34 and a sealing member 35 are disposed in an inner surface of cylindrical portion 31*a*. A central bore 32*a* is formed around the central axis of cylinder block 32. A radial bearing 36 is disposed in central bore 32*a*. A plurality of cylinder bores 32*b* are formed in cylinder block 32 and are radially arranged with respect to the central axis of cylinder block 32. Each of cylinder bores 32*b* extends parallel with the central axis of cylinder block 32. A discharge chamber 33*a* and a suction chamber 33*b* are formed in cylinder head 33, which abuts against one end of cylinder block 32*b* via a valve plate 17. Front housing 31, cylinder block 32, valve plate 17, and cylinder head 33 are fixed together by a plurality of bolts 37.

A drive shaft 5 extends along a central axis of compressor 1 and through crank chamber 31*b*, and is rotatably supported by front housing 31 through radial bearing 34 at one end and central bore 32*a* of cylinder block 32 through radial bearing 36 at the other end. A pulley 40, which is rotatably supported by and mounted on front housing 31, is connected to drive shaft 5. A drive belt (not shown) is provided to transfer motion between pulley 40 and a crankshaft of an engine of a vehicle (not shown).

A rotor 7 has an arm 71, which has a pin 91 at its end. Rotor 7 is fixed on drive shaft 5 and is located in crank chamber 31*b*. Rotor 7 is supported by a needle bearing 38 toward the thrust direction. Needle bearing 38 is attached to an inner wall of front housing 31. A swash plate 9 is substantially disc shaped and is slidably mounted on drive shaft 5. Swash plate 9 has an arm 92, which is rotatably connected with arm 71 of rotor 7 by means of pin 91, so that swash plate 9 is rotated along with drive shaft 5 and permits a change of the inclination angle of swash plate 9 relative to the axial direction of drive shaft 5. The displacement volume of compressor 1 varies in accordance with the change of the inclination angle in the manner known in the art.

As shown in FIGS. 1*a*–1*h*, a piston 13 has an end portion 131, a cylindrical portion 132, and a connecting portion 134. A groove 131*a*, which receives a piston ring (not shown), is formed on an outer peripheral surface of cylindrical portion 132 and is adjacent to end portion 131. Cylindrical portion 132 and connecting portion 134 are integrally formed. End portion 131 and cylindrical portion 132 are divided at about groove 131*a* and are casted separately. A head portion consists of these divided two portions of end portion 131 and cylindrical portion 132, which are connected, e.g., by a caulking or a welding. The head portion may be formed to be in slidable contact with a cylindrical surface of cylinder bore 32*b*. A pair of penetrating apertures 136 are pierced through an end surface of cylindrical portion 132 adjacent to connecting portion 134. A rib 137 is formed on an inner surface of cylindrical portion 132 and is located between the pair of penetrating apertures 136 at cylindrical portion 132.

As shown in FIG. 1*g*, rib 137 has a substantially triangular shape in cross-section, which has a wider width at the bottom and a narrower width at the tip in a direction perpendicular to the line segment connecting between two penetrating apertures 136. Further, rib 137 is formed in parallel with the axial line of piston 13. The cross-sectional shape of rib 137 is not limited to a triangular shape. The strength of a portion of the piston between the pair of penetrating apertures 136 may be increased due to rib 137. As a result, when compressor 1 is operated under a high load, the occurrence of cracks at the circumference portion of penetrating aperture 136 may be reduced or eliminated. Connecting portion 134 has a substantially horseshoe shape and is integrally formed with cylindrical portion 132. Connecting portion 134 has a pair of shoe receivers 134*a*, which face each other. Each of shoe receiver 134*a* has a hemispherical hollow portion.

As shown in FIGS. 1*a*–2, a plurality of pairs of hemispherical sliding shoes 15 are slidably disposed on shoe receivers 134*a* and are radially disposed on either side surface of swash plate 9. Each of the pairs of sliding shoes 15 are arranged with respect to the central point of each side surface of swash plate 9. Thus, connecting portion 134 of piston 13 is connected to swash plate 9 with a pair of shoes 15 disposed therebetween. By this structure, a rotational movement of swash plate 9 by drive shaft 5 is converted into a liner reciprocating movement and then transmitted to piston 13. Consequently, piston 13 is reciprocally moved in the cylinder bore 32*b* to thereby provide a suction/exhaust operation of piston 13.

Referring to FIGS. 3*a*–3*h*, the structure of a piston, according to a second embodiment of the present invention, is shown. The swash plate-type compressor of FIG. 2 also may include the piston of FIGS. 3*a*–3*h*. In the following explanation, because the structure of the piston of the second embodiment of the present invention is substantially similar to the structure of the piston of the first embodiment of the present invention, the same reference numbers are used to represent similar parts of the piston of the first embodiment of the present invention. Therefore, further explanation of similar parts is here omitted.

Figures 3A, 3B, 3C, 3D, 3E, 3F, 3G, 3H:
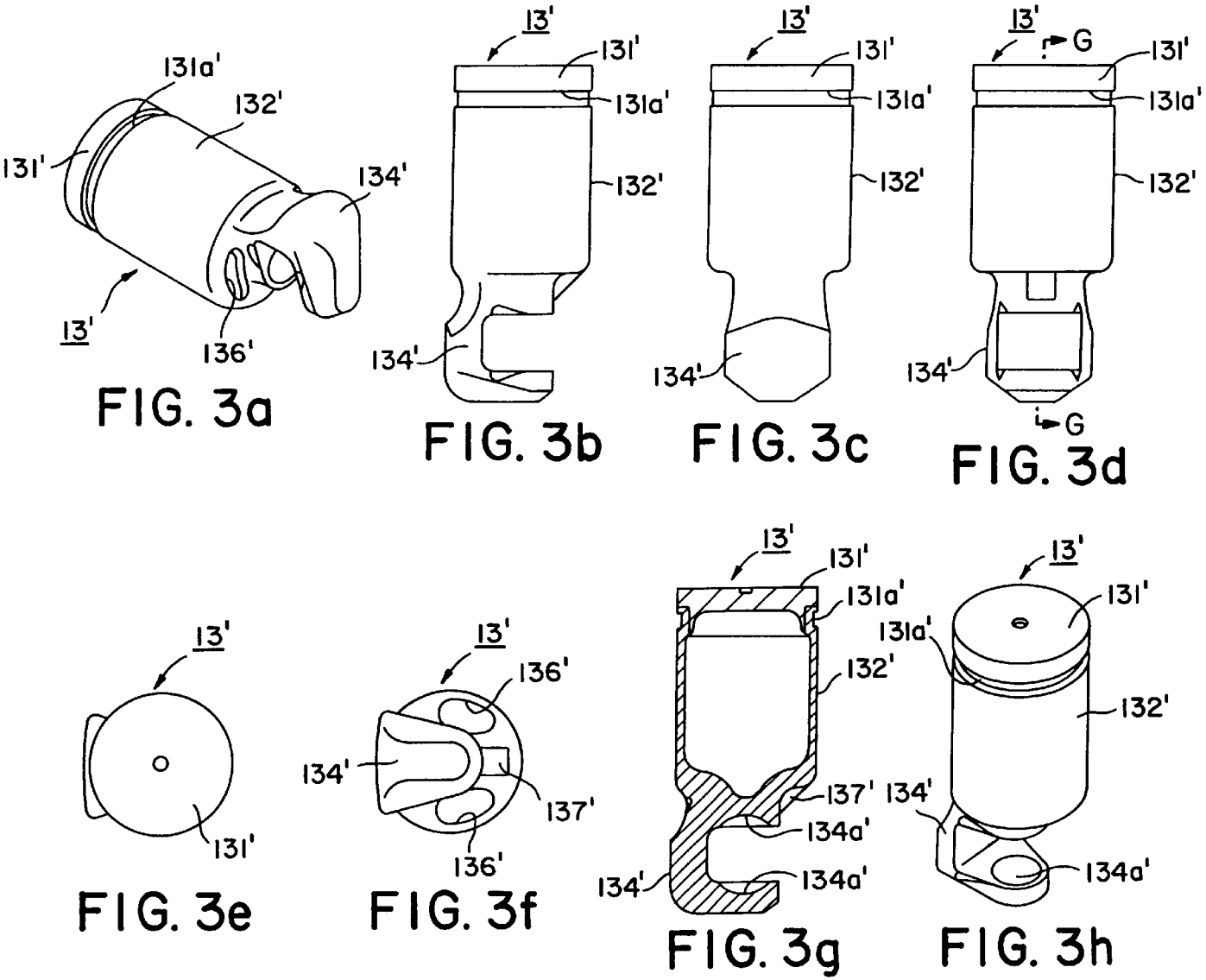
FIG. 3*a* is a perspective view of a piston seen from a connecting portion of the piston, according to a second embodiment of the present invention.
FIG. 3*b* is a front view of the piston, according to the second embodiment of the present invention.
FIG. 3*c* is a left side view of the piston, according to the second embodiment of the present invention.
FIG. 3*d* is a right side view of the piston, according to the second embodiment of the present invention.
FIG. 3*e* is a top plan view of the piston, according to the second embodiment of the present invention.
FIG. 3*f* is a bottom plan view of the piston, according to the second embodiment of the present invention.
FIG. 3*g* is a cross-sectional view taken along the line G—G of FIG. 3*d*.
FIG. 3*h* is another perspective view of the piston seen from an end portion of the piston, according to the second embodiment of the present invention.

In the piston of the second embodiment of the present invention, a rib 137' is formed on inner surface of cylindrical portion 132' and is located between the pair of penetrating apertures 136' at cylindrical portion 132'. As shown in FIG. 3*g*, rib 137' has a substantially triangular shape in cross-section, the oblique line of the triangular shape connects between an end surface of cylindrical portion 132' and connecting portion 134'. Further, rib 137' is formed parallel to the axial line of piston 13'. The cross-sectional shape of rib 137' is not limited to a triangular shape. The strength of a portion between the pair of penetrating apertures 136' may be increased due to rib 137'. As a result, when compressor 1 is operated under a high load, the occurrence of cracks at the circumference portion of penetrating aperture 136' may be reduced or eliminated.

In the embodiments of the present invention, rib 137 or 137' may be formed between a pair of penetrated apertures 136 or 136' at cylinder portion 132 or 132'. Forming a rib on an inner surface of a cylindrical portion or on an outer surface of the cylindrical portion of a piston may be chosen in accordance with the difficulty of the production of the metallic mold of the cylindrical portion. Moreover, although the embodiments of the present invention are applied to the swash plate-type compressor, the present invention may be applied to any compressors, fluid displacement apparatus, or pumps that have a piston.

As described above, in a piston for use in a compressor with respect to embodiments of the present invention, a piston 13 has an end portion 131, a cylindrical portion 132, and a connecting portion 134. A head portion comprises two divided portions: end portion 131 and cylindrical portion 132, which are connected, e.g., by a caulking or a welding. The head portion may be formed to be in slidable contact with a cylindrical surface of cylinder bore 32*b*. A pair of penetrating apertures 136 are pierced through cylindrical portion 132 at an end surface of cylindrical portion 132 adjacent to connecting portion 134. A rib 137 is formed on inner surface of cylindrical portion 132 and is located between the pair of penetrating apertures 136 at cylindrical portion 132. Rib 137 has a substantially triangular shape in cross-section, which has wider width of the bottom and a narrower width at the tip in the direction perpendicular to the line segment connecting between two penetrating apertures 136. Further, rib 137 is formed in parallel with the axial line of piston 13. The strength of a portion between the pair of penetrating apertures 136 may be increased by to rib 137. As a result, when compressor 1 is operated under a high load, the occurrence of cracks at the circumference portion of penetrating aperture 136 may be reduced or eliminated.

Although the present invention has been described in connection with preferred embodiments, the invention is not limited thereto. It will be understood by those skilled in the art that variations and modifications may be made within the scope and spirit of this invention, as defined by the following claims.

What is claimed is:

1. A piston for use in a fluid displacement apparatus comprising:

a head portion having a cylindrical shape and a hollow structure;

a connecting portion extending from an end surface of said head portion and coupling said piston with a moving source; and an aperture formed through said end surface of said head portion adjacent to said connecting portion, wherein a rib is formed adjacent to said aperture.

2. The piston of claim 1, wherein said rib is formed on an inner surface of said head portion.

3. The piston of claim 1, wherein said rib is formed on an outer surface of said head portion.

4. The piston of claim 1, wherein said fluid displacement apparatus is a swash plate-type compressor.

5. A piston for use in a fluid displacement apparatus comprising:

a head portion having a cylindrical shape and a hollow structure, said head portion comprising an end portion and a cylindrical portion, said end portion fixedly connected to said cylindrical portion;

a connecting portion extending from an end surface of said cylindrical portion and coupling said piston with a moving source; and a pair of apertures formed through said end surface of said cylindrical portion adjacent to said connecting portion, wherein a rib is formed between said pair of apertures.

6. The piston of claim 5, wherein said rib is formed on an inner surface of said head portion.

7. The piston of claim 5, wherein said rib is formed on an outer surface of said head portion.

8. The piston of claim 5, wherein said fluid displacement apparatus is a swash plate-type compressor.

* * * * *